US009974714B1

(12) United States Patent
Middleton

(10) Patent No.: US 9,974,714 B1
(45) Date of Patent: May 22, 2018

(54) PACIFIER DISPENSER

(71) Applicant: Elroy Middleton, Nashville, TN (US)

(72) Inventor: Elroy Middleton, Nashville, TN (US)

( * ) Notice: Subject to any disclaimer, the term of this patent is extended or adjusted under 35 U.S.C. 154(b) by 282 days.

(21) Appl. No.: 14/932,515

(22) Filed: Nov. 4, 2015

Related U.S. Application Data

(63) Continuation-in-part of application No. 13/852,910, filed on Mar. 28, 2013, now abandoned.

(51) Int. Cl.
*A61J 17/00* (2006.01)
*A61J 7/00* (2006.01)

(52) U.S. Cl.
CPC ..... *A61J 17/006* (2015.05); *A61J 7/0015* (2013.01)

(58) Field of Classification Search
CPC ..... A61J 17/00; A61J 17/006; A61J 11/0015; A61J 11/0035
USPC ..... 606/234–236
See application file for complete search history.

(56) References Cited

U.S. PATENT DOCUMENTS 5,354,274 A * 10/1994 Demeter ..... A61J 7/0046 215/11.1
2011/0046671 A1* 2/2011 Okoturo ..... A61J 7/0053 606/236

* cited by examiner

*Primary Examiner* — Katherine M Shi
(74) *Attorney, Agent, or Firm* — Shane V. Cortesi

(57) ABSTRACT

A pacifier for dispensing medicine to a human infant is disclosed. In some embodiments, the pacifier includes a medicine container that is located between the mouth guard front side and the mouth guard rear side. In other embodiments, the pacifier includes a pacifier housing that is formed by a mouth guard flange and a cap mating and the medicine container is located in the pacifier housing interior.

12 Claims, 10 Drawing Sheets

PACIFIER DISPENSER

RELATED APPLICATIONS

This application is a continuation-in-part of U.S. patent application Ser. No. 13/852,910, filed Mar. 28, 2013, which is incorporated herein by reference in its entirety.

BACKGROUND

Technical Field

The present invention relates to pacifiers for administering medicine to humans, more particularly babies.

Background of the Invention

It is notoriously difficult to administer medicine to infants.

U.S. Pat. No. 5,601,605 to Crowe teaches a pacifier for dispensing medicine that includes a shield-shaped body, and an insert that includes a compressible bulb means at one end and a nipple means at the other end that passes through the shield-shaped body. As described in Crowe, "the nipple means and bulb means jointly comprise a unitary, substantially hermetically sealed element" and the valve is opened by a user pressurizing the bulb means. One of the problems of Crowe is that the medicine is held in the compressible bulb means. Thus, the pacifier can accidentally dispense medicine if the compressible bulb means is bumped. U.S. Patent Publication No. 2014/0296915 by Finney teaches a similar pacifier to Crowe.

U.S. Pat. No. 7,753,886 to Vath teaches a medicine dispensing pacifier that has a centered nipple upon a guard and a reservoir communicating through the guard to the nipple. The reservoir, opposite the guard, has a cap, and upon removing it, a caregiver places medicine into the reservoir. Then the caregiver returns the cap to seal the reservoir. The infant then suckles the nipple, ingesting the medicine drawn from the reservoir. Among other issues, U.S. Pat. No. 7,753,886 is not tamper proof because the cap can easily be unscrewed.

Thus, there is a continuing need for pacifiers that dispense medicine.

BRIEF SUMMARY

The present disclosure provides pacifiers for dispensing medicine as described herein.

In some embodiments, the present disclosure provides a pacifier configured to administer a liquid to a human having a face and a mouth, the pacifier comprising: a mouth guard comprising a mouth guard rear side configured to rest against the face of the human, a mouth guard front side opposite the mouth guard rear side and comprising a flange extending away from the mouth guard front side generally perpendicular to the mouth guard front side; a cap comprising a cap front side, a cap rear side, and a hollow cap interior between the cap front side and the cap rear side, the cap mating with the flange to form a pacifier housing comprising a pacifier housing interior; a medicine container located in the pacifier housing interior and configured to hold a medicinal liquid; a nipple comprising a nipple front side extending from the mouth guard rear side, a nipple rear side configured to be inserted in the human's mouth, a nipple interior, a nipple entrance aperture located adjacent to the nipple front side, a nipple exit aperture located adjacent to the nipple rear side, and a nipple channel connecting the nipple entrance aperture and the nipple exit aperture, the nipple channel located in the nipple interior; and a valve located between the medicine container and the nipple exit aperture, the valve having a closed position in which the valve prevents liquid located in the medicine container from flowing out the nipple exit aperture and an open position in which the valve allows liquid located in the medicine container to flow out the nipple exit aperture.

Optionally, the medicine container is located entirely within the pacifier housing interior. Optionally, the medicine container comprises a medicine container front side adjacent to the cap front side and a medicine container rear side adjacent to the mouth guard front side, wherein the medicine container rear side comprises a medicine container exit aperture, wherein the mouth guard comprises a stem comprising a stem front side engaging the medicine container exit aperture, a stem rear side engaging the nipple, and a hollow stem interior, and further wherein the medicine container is in fluid communication with the stem front side, the stem rear side, the hollow stem interior, and the nipple exit aperture when the valve is in the open position. Optionally, when the valve is in the open position, a medicinal liquid located in the medicine container is configured to flow sequentially from the medicine container, through the medicine container exit aperture, through the stem front side, through the hollow stem interior, through the stem rear side, through the nipple channel, through the nipple exit aperture and into the human's mouth. Optionally, the stem comprises an indentation located adjacent to the stem rear side and extending about a perimeter of the stem, wherein the valve is generally cylindrical in shape and further wherein the valve is positioned in the indentation. Optionally, the cap rear side is flush with the mouth guard front side. Optionally, the flange forms a perimeter around a recessed area, the recessed area having a rear side defined by the mouth guard front side and further wherein the recessed area and the cap interior define the pacifier housing interior. Optionally, the medicine container is rigid. Optionally, the valve is configured to move from the closed position to the open position when the human sucks on the nipple exit aperture. Optionally, the nipple channel is coated with silicone, the silicone coated nipple channel configured to allow liquid to flow freely through the silicone coated nipple channel. Optionally, the valve and the nipple entrance aperture have the same shape and further wherein the valve and the nipple are comprised of the same material. Optionally, the valve comprises x- shaped slits, the x-shaped slits configured to open when the human sucks on the nipple exit aperture.

In still further embodiments, the present disclosure provides a method of administering medicine using a pacifier comprising a) administering the pacifier to a human so that the mouth guard rear side is against the human's face; b) allowing the human to suck on the nipple exit aperture and cause the valve to move from the closed position to the open position; c) flowing a liquid sequentially from the medicine container, through the nipple channel, through the nipple exit aperture and into the human's mouth. Optionally, the medicine container of the pacifier comprises a medicine container front side adjacent to the cap front side and a medicine container rear side adjacent to the mouth guard front side, wherein the medicine container rear side comprises a medicine container exit aperture, wherein the mouth guard comprises a stem comprising a stem front side engaging the medicine container exit aperture, a stem rear side engaging the nipple, and a hollow stem interior, and step c) comprises flowing a medicinal liquid sequentially from the medicine container, through the medicine container exit aperture, through the stem front side, through the hollow stem interior, through the stem rear side, through the nipple channel, through the nipple exit aperture and into the human's mouth.

In still further embodiments, the present disclosure provides a pacifier configured to administer a liquid to a human having a face and a mouth, the pacifier comprising: a mouth guard comprising a mouth guard rear side configured to rest against the face of the human, a mouth guard front side opposite the mouth guard rear side, and a mouth guard interior; a medicine container located entirely in the mouth guard interior and configured to hold a medicinal liquid and comprising a medicine container exit aperture; a nipple comprising a nipple front side extending from the mouth guard rear side, a nipple rear side configured to be inserted in the human's mouth, a nipple interior, a nipple entrance aperture located adjacent to the nipple front side, a nipple exit aperture located adjacent to the nipple rear side, and a nipple channel connecting the nipple entrance aperture and the nipple exit aperture, the nipple channel located in the nipple interior; and a valve located between the medicine container and the nipple exit aperture, the valve having a closed position in which the valve prevents liquid located in the medicine container from flowing out the nipple exit aperture and an open position in which the valve allows liquid located in the medicine container to flow out the nipple exit aperture.

Optionally, the mouth guard comprises a stem comprising a stem front side engaging the medicine container exit aperture, a stem rear side engaging the nipple, and a hollow stem interior, and further wherein the medicine container is in fluid communication with the stem front side, the stem rear side, the hollow stem interior, and the nipple exit aperture when the valve is in the open position. Optionally, when the valve is in the open position, a medicinal liquid located in the medicine container is configured to flow from the medicine container, through the medicine container exit aperture, through the stem front side, through the hollow stem interior, through the stem rear side, through the nipple channel, through the nipple exit aperture and into the human's mouth. Optionally, the mouth guard comprises a plurality of breathing holes extending from the mouth guard front side to the mouth guard rear side, the breathing holes configured to allow the human to breathe through the breathing holes when the nipple is located in the human's mouth.

In still further embodiments, the present disclosure provides a method of administering medicine using a pacifier comprising a)administering the pacifier to a human so that the mouth guard rear side is against the human's face; b) allowing the human to suck on the nipple exit aperture and cause the valve to move from the closed position to the open position; and c) flowing a liquid from the medicine container, through the nipple channel, through the nipple exit aperture and into the human's mouth. Optionally, the medicine container comprises a medicine container exit aperture, wherein the mouth guard of the pacifier comprises a stem comprising a stem front side engaging the medicine container exit aperture, a stem rear side engaging the nipple, and a hollow stem interior, and step c) comprises flowing a medicinal from the medicine container, through the medicine container exit aperture, through the stem front side, through the hollow stem interior, through the stem rear side, through the nipple channel, through the nipple exit aperture and into the human's mouth.

DETAILED DESCRIPTION

Figure 1:
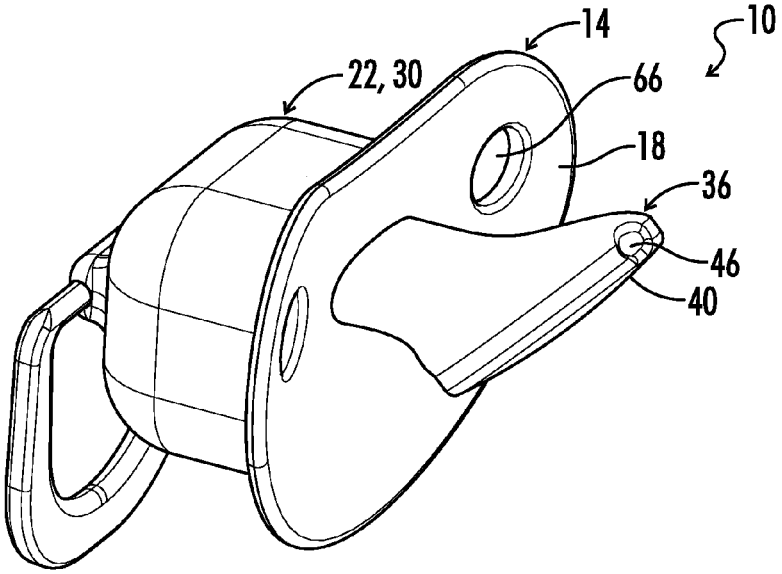
FIG. 1 illustrates a side, perspective view of a pacifier of one embodiment of the present invention.

The present disclosure provides two general embodiments of a pacifier for dispensing medicine to a child. FIGS. 1-6 provide one embodiment of a pacifier 10 in which the liquid medicine 12 is located in a medicine container 34 that is located inside the pacifier housing interior 32. FIGS. 7-13 provide another embodiment of a pacifier 100 in which the medicine 104 is located in a medicine container 112 that is located inside the mouth guard 102. In the drawings, not all reference numbers are included in each drawing for the sake of clarity.

Figure 4:
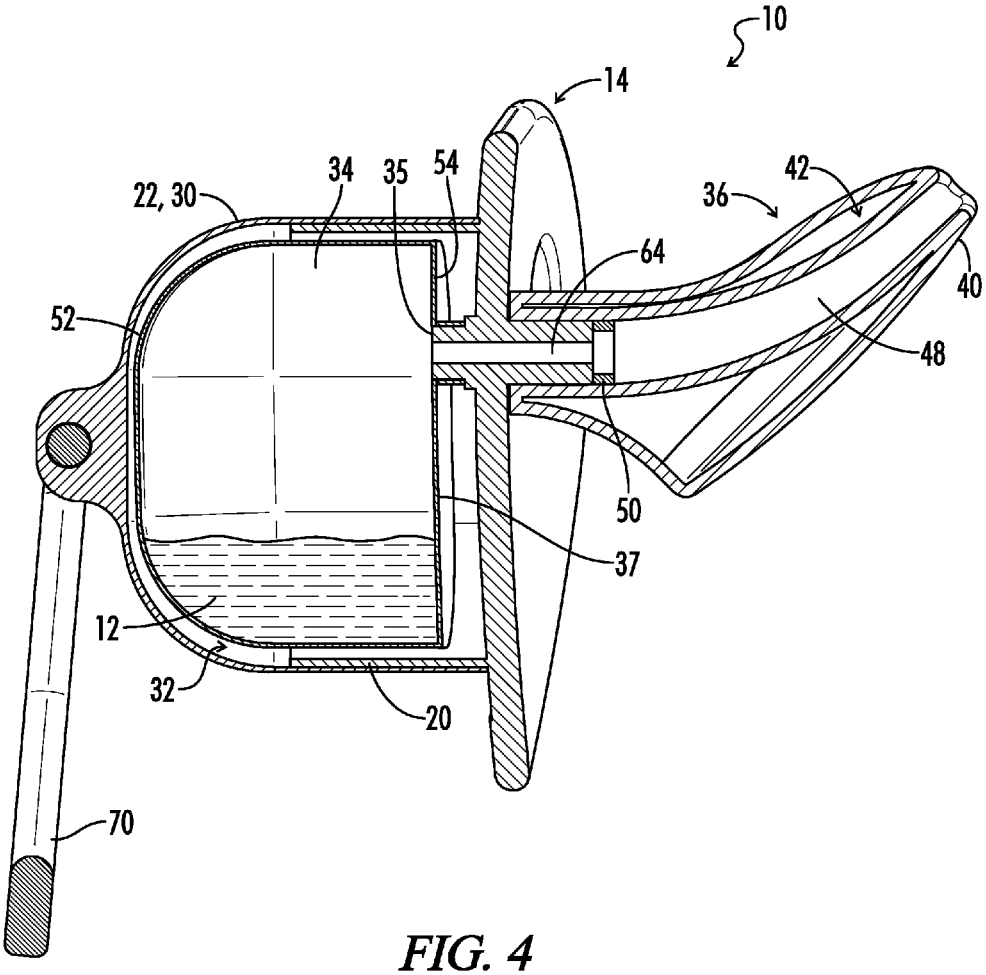
FIG. 4 illustrates a side, cross-sectional view of the pacifier of FIG. 1, taken along line 4-4 of FIG. 3.
Figure 5:
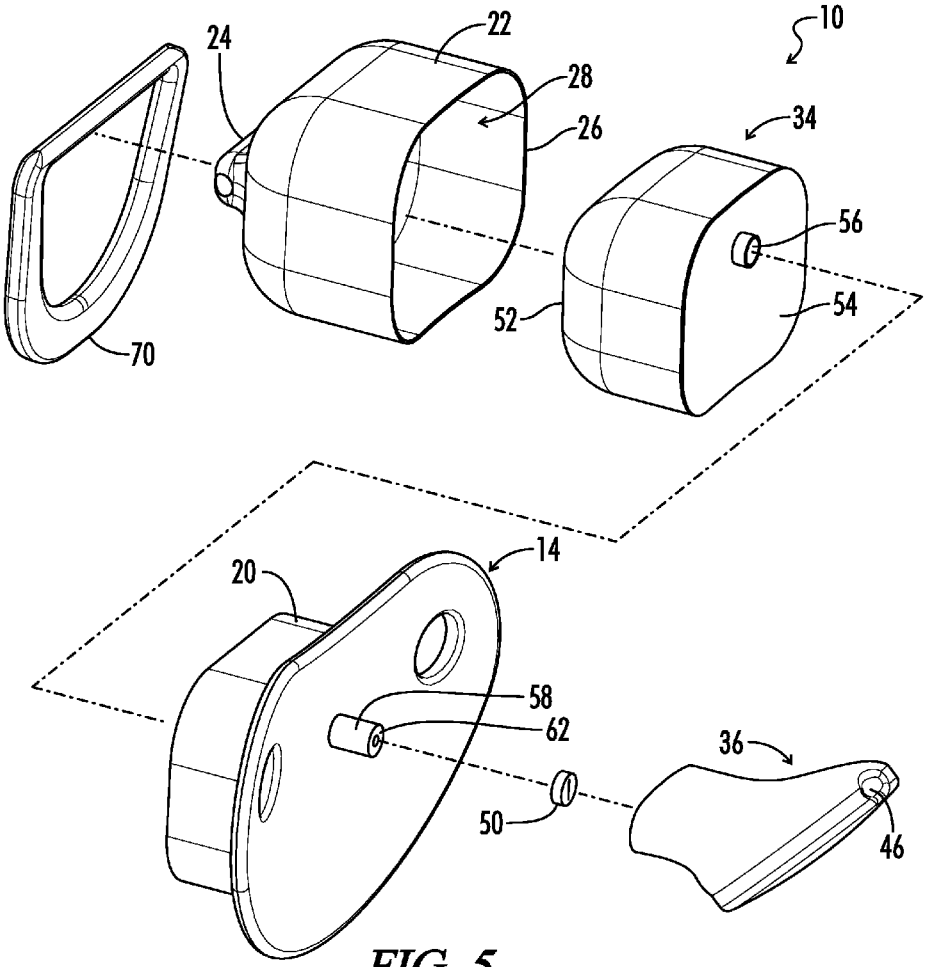
FIG. 5 illustrates a side, exploded view of the pacifier of FIG. 1.

With reference to FIGS. 1-6, in some embodiments, the pacifier 10 includes a mouth guard 14 comprising a mouth guard rear side 18 configured to rest against the face of the human, a mouth guard front side 16 opposite the mouth guard rear side 18 and comprising a flange 20 extending away from the mouth guard front side 16 generally perpendicular to the mouth guard front side 16. The pacifier 10 further includes a cap 22 comprising a cap front side 24, a cap rear side 26, and a hollow cap interior 28 between the cap front side 24 and the cap rear side 26, the cap 22 mating with the flange 20 to form a pacifier housing 30 comprising a pacifier housing interior 32. (It will be understood that the cap rear side 26 may be open, as best seen in FIG. 5). The pacifier 10 further includes a medicine container 34 located in the pacifier housing interior 32 and configured to hold a medicinal liquid 12 (e.g., a medicinal solution comprising a pharmaceutically active ingredient such as acetaminophen). The pacifier 10 further includes a nipple 36 comprising a nipple front side 38 extending from the mouth guard rear side 18, a nipple rear side 40 configured to be inserted in the human's mouth, a nipple interior 42, a nipple entrance aperture 44 located adjacent to (i.e., at or near) the nipple front side 38, a nipple exit aperture 46 located adjacent to the nipple rear side 40, and a nipple channel 48 connecting the nipple entrance aperture 44 and the nipple exit aperture 46, the nipple channel 48 located in the nipple interior 42. The pacifier 10 further includes a spill proof valve 50 located between the medicine container 34 and the nipple exit aperture 46 (more specifically between the stem 58 and the nipple entrance aperture 44), the valve 50 having a closed position in which the valve 50 prevents liquid 12 located in the medicine container 34 from flowing out the nipple exit aperture 46 and an open position in which the valve 50 allows liquid 12 located in the medicine container 34 to flow out the nipple exit aperture 46. (In other words, when the valve 50 is closed, the medicine container 34 is not in fluid communication with at least the nipple exit aperture 46).

The medicine container 34 is preferably rigid and non-compressible so that the shape of the medicine container 34 does not change when the human sucks on the nipple exit aperture 46.

Figure 2:
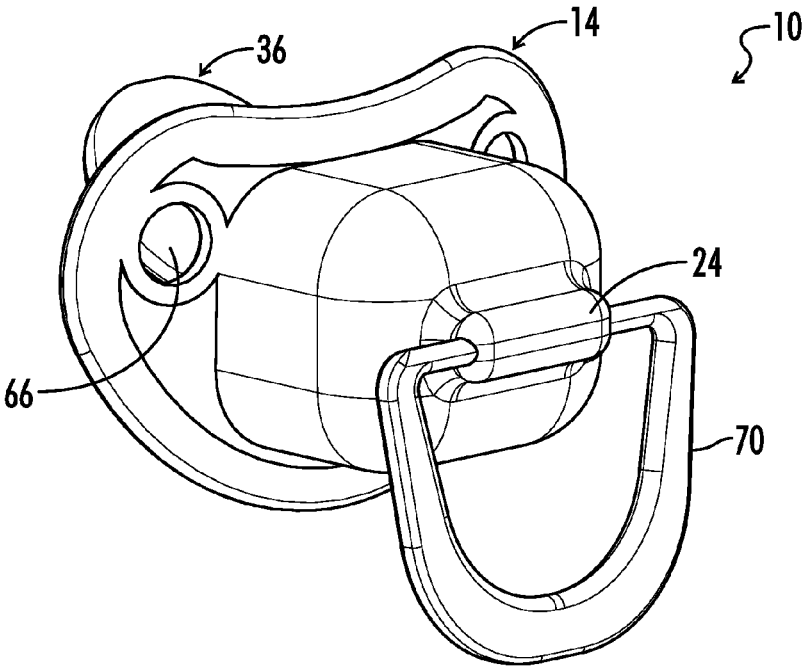
FIG. 2 illustrates a front, perspective view of the pacifier of FIG. 1.
Figure 3:
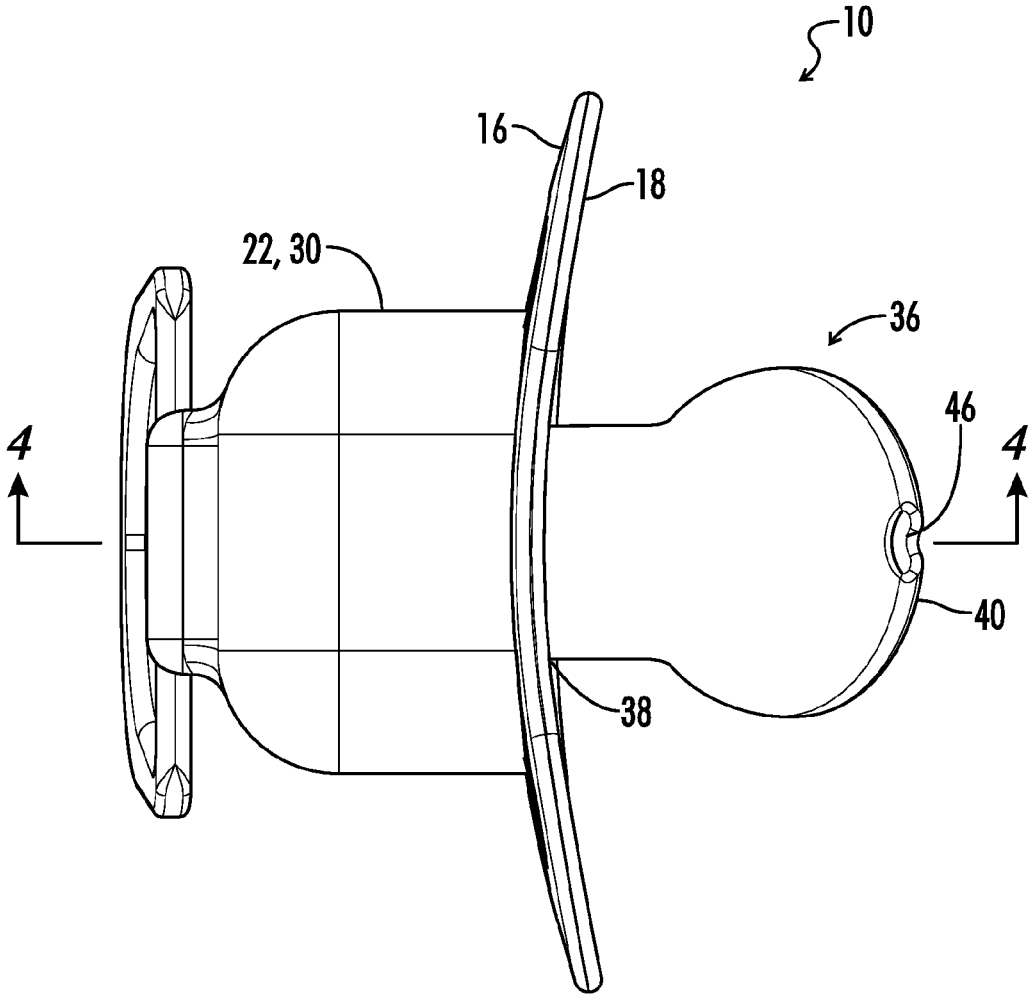
FIG. 3 illustrates a top, plan view of the pacifier of FIG. 1.

Optionally, the medicine container 34 is located entirely within the pacifier housing interior 32, as best seen in FIGS. 2 and 4. Optionally, the medicine container 34 comprises a medicine container front side 52 adjacent to the cap front side 24 and a medicine container rear side 54 adjacent to the mouth guard front side 16. In such a case, the medicine container rear side 54 may comprise a medicine container exit aperture 56, the mouth guard 14 may comprise a stem 58 comprising a stem front side 60 engaging the medicine container exit aperture 56, a stem rear side 62 engaging the nipple 36, and a hollow stem interior 64. Optionally, the medicine container 34 is in fluid communication with the stem front side 60, the stem rear side 62, the hollow stem interior 64, and the nipple exit aperture 46 when the valve 50 is in the open position. Optionally, when the valve 50 is in the open position, a medicinal liquid 12 located in the medicine container 34 is configured to flow (sequentially) from the medicine container 34, through the medicine container exit aperture 56, through the stem front side 60, through the hollow stem interior 64, through the stem rear side 62, through the nipple channel 48, through the nipple exit aperture 46 and into the human's mouth. (It will also be appreciated that the medicinal liquid 12 may flow through other structures such as the valve 50).

Figure 4A:
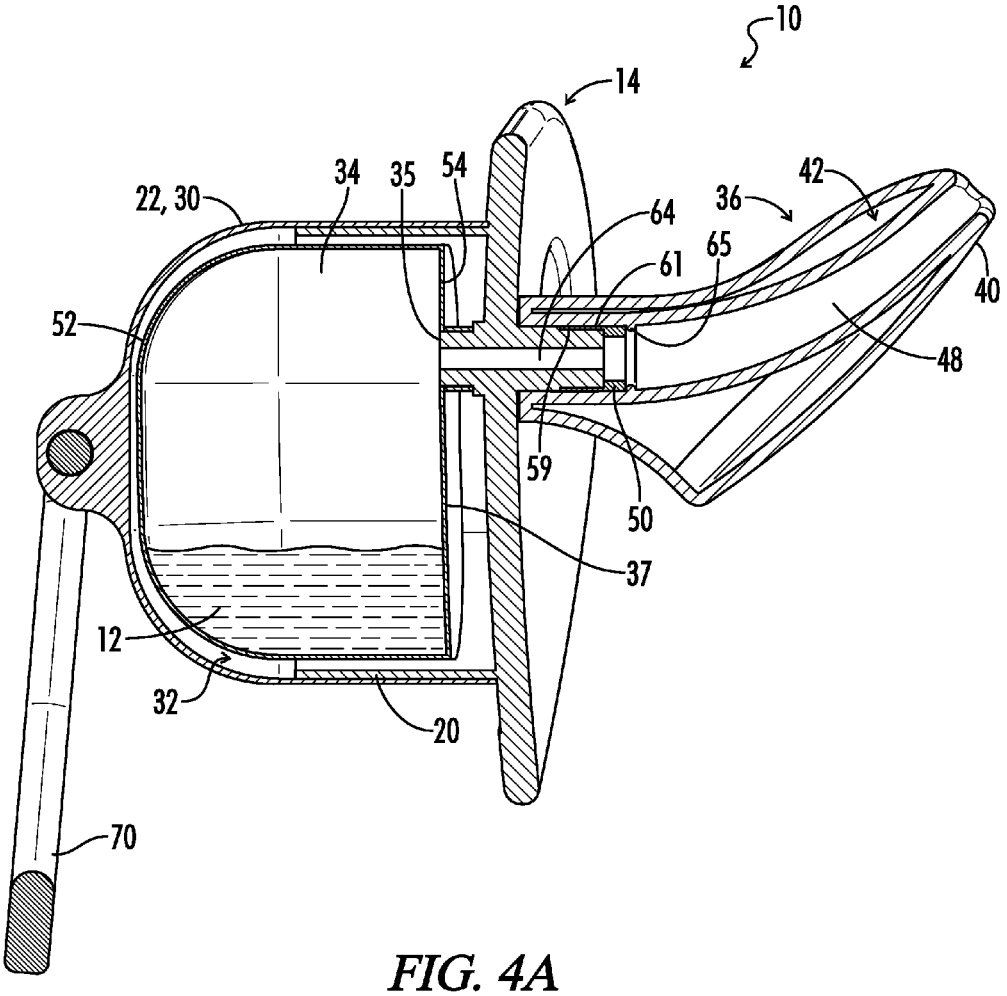
FIG. 4A illustrates a side, cross-sectional view of the pacifier of FIG. 1 with an alternate design of the valve, stem and nipple channel.
Figure 5A:
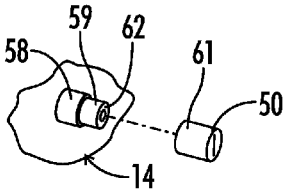
FIG. 5A illustrates a side, perspective view of an the valve and stem of FIG. 4A.
Figure 6:
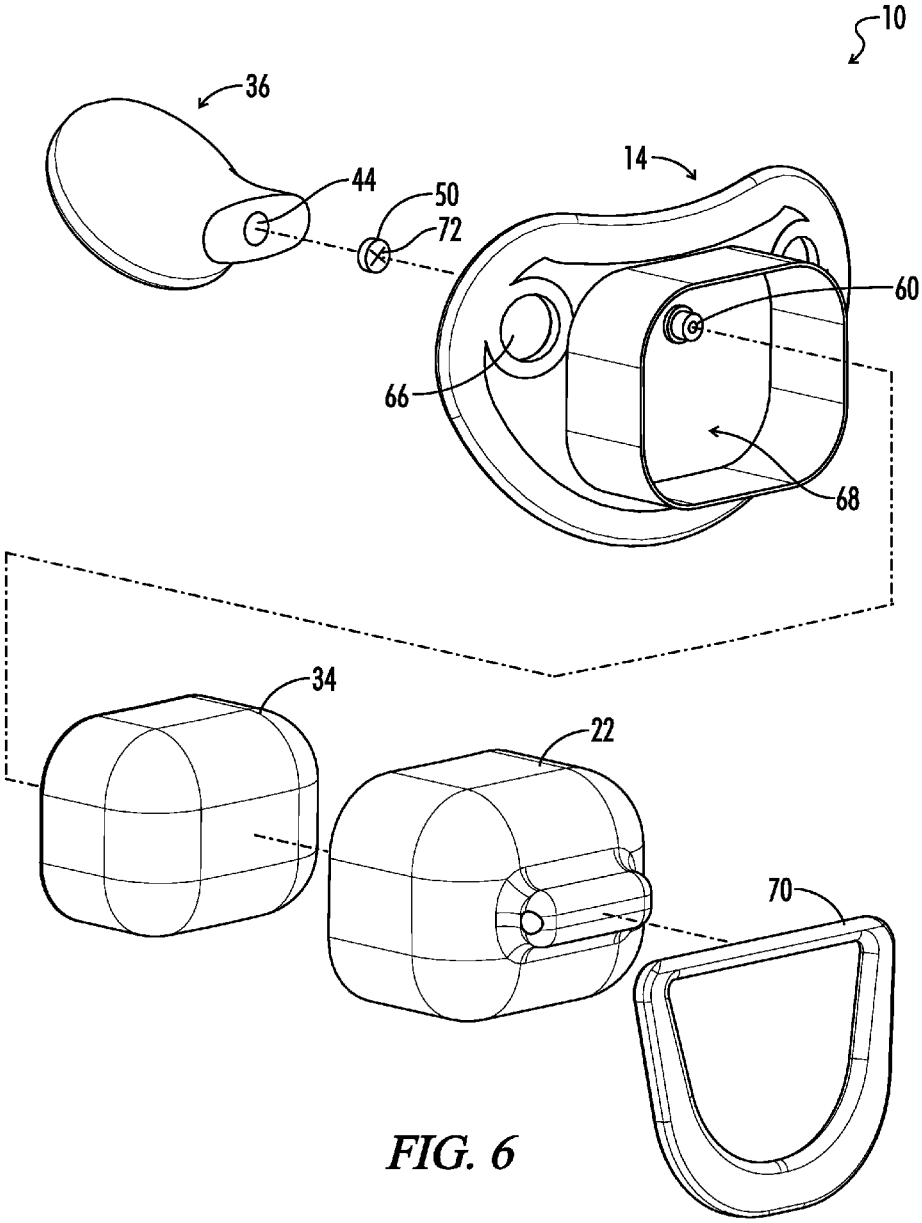
FIG. 6 illustrates a front, exploded, view of the pacifier of FIG. 1.
Figure 7:
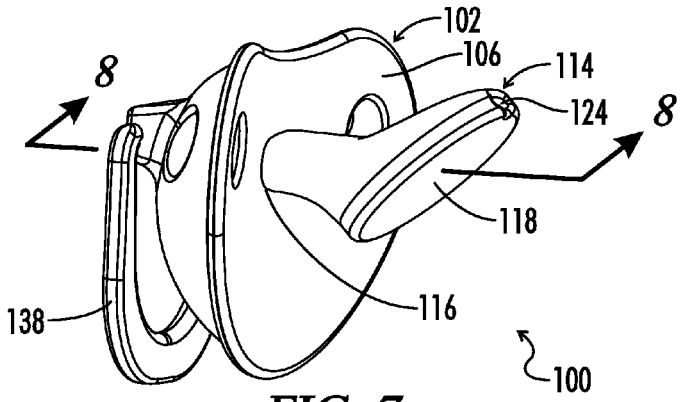
FIG. 7 illustrates a side, perspective view of a pacifier of another embodiment of the present invention.
Figure 8:
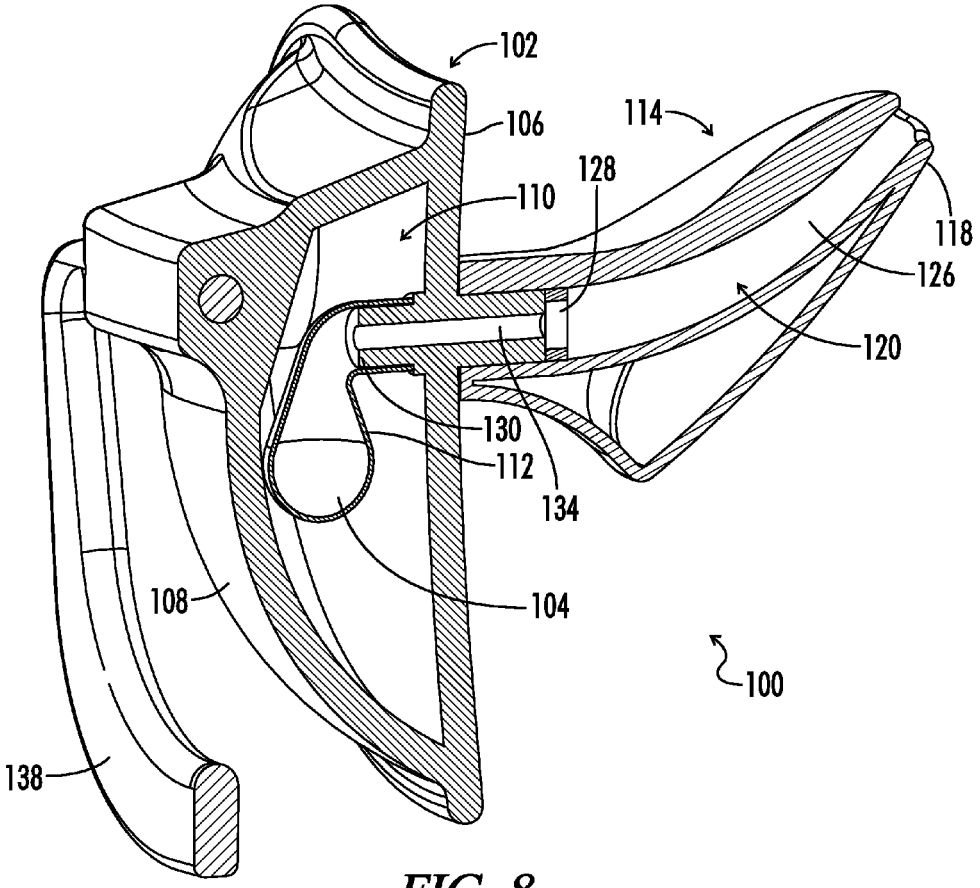
FIG. 8 illustrates a side, cross-sectional view of the pacifier of FIG. 7, taken along line 8-8 of FIG. 7.
Figure 9:
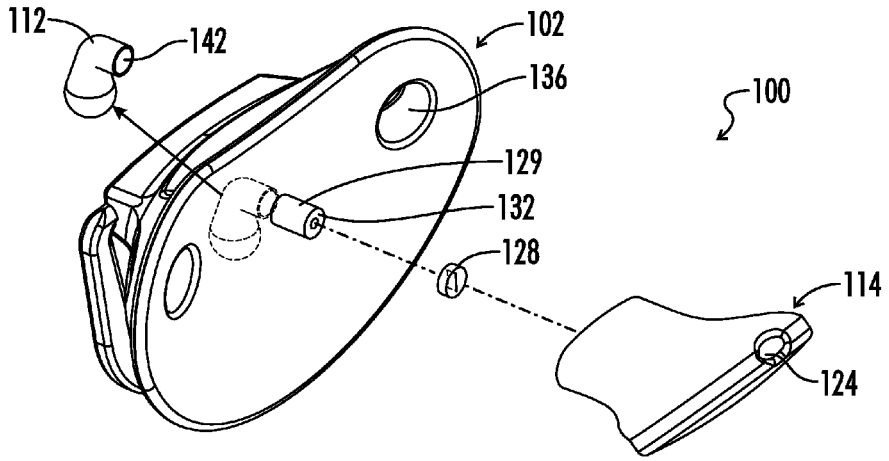
FIG. 9 illustrates a rear, exploded view of the pacifier of FIG. 7.
Figure 10:
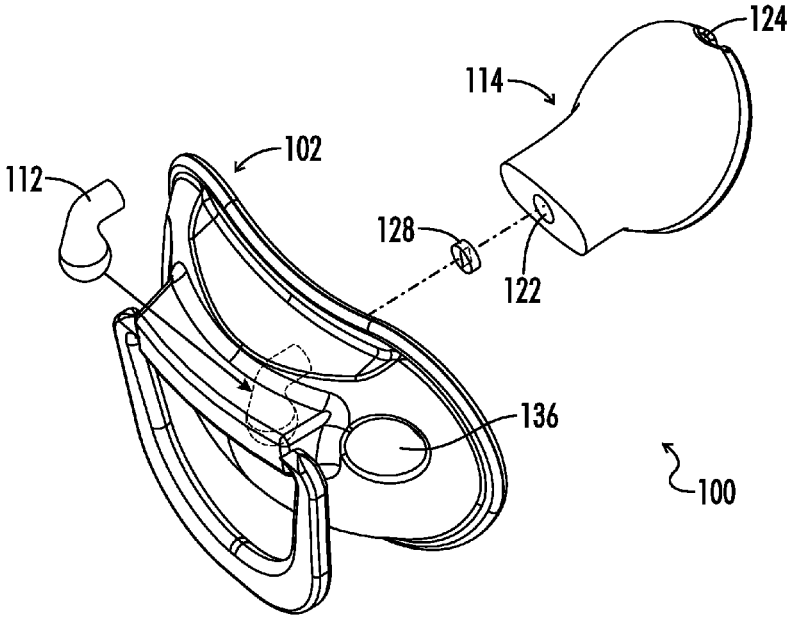
FIG. 10 illustrates a front, exploded view of the pacifier of FIG. 7.
Figure 11:
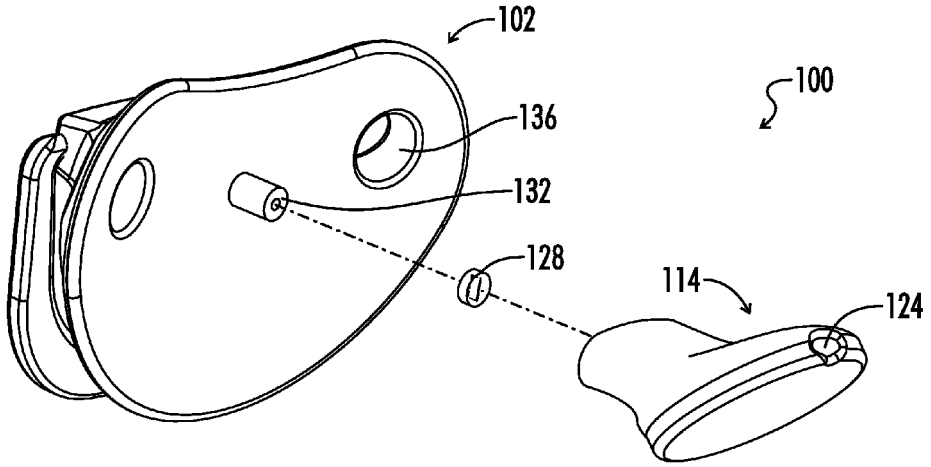
FIG. 11 illustrates another rear, exploded view of the pacifier of FIG. 7.
Figure 12:
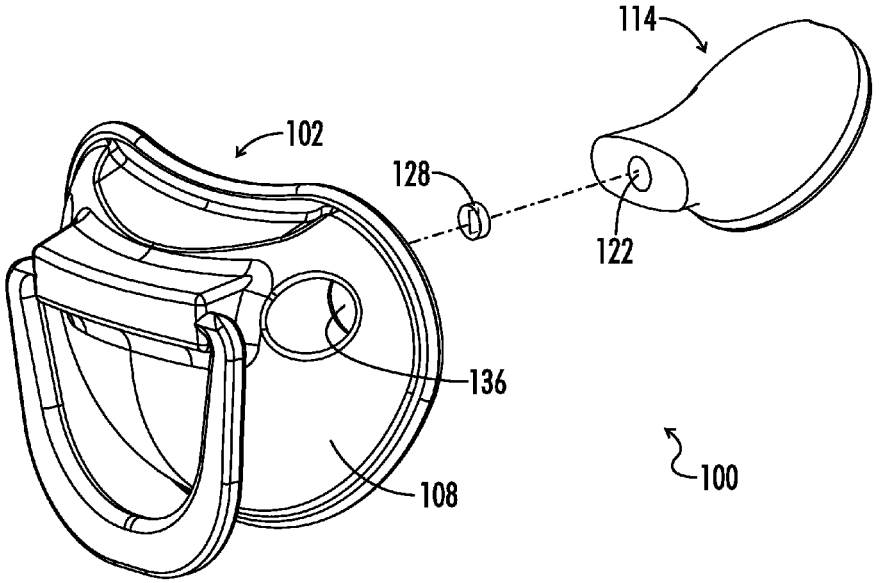
FIG. 12 illustrates another front, exploded view of the pacifier of FIG. 7.
Figure 13:
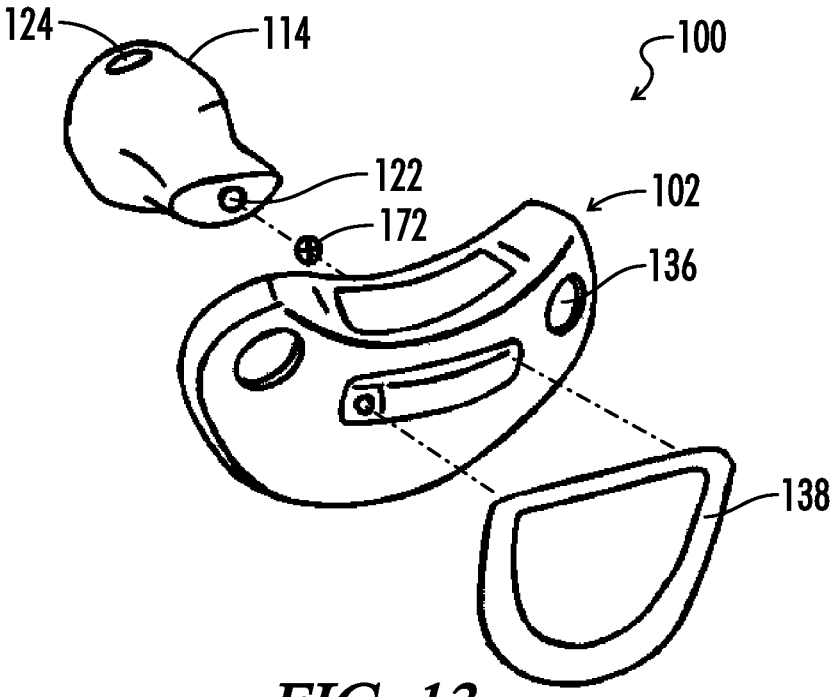
FIG. 13 illustrates a front, exploded view of a pacifier of another embodiment of the present invention.

Optionally, the mouth guard 14 comprises a plurality of breathing holes 66 extending from the mouth guard front side 16 to the mouth guard rear side 18, the breathing holes 66 configured to allow the human to breathe through the breathing holes 66 when the nipple 36 is located in the human's mouth. Optionally, the cap rear side 26 is flush with the mouth guard front side 16, as best seen in FIGS. 2 and 4. Optionally, the flange 20 forms a perimeter around a recessed area 68, the recessed area 68 having a rear side defined by the mouth guard front side 16, as best seen in FIG. 6, and the recessed area 68 and the cap interior 28 define the pacifier housing interior 32. Optionally, the cap front side 24 comprises a ring handle 70. Optionally, the medicine container 34 holds a single dose of liquid medicine. For example, the medicine container 34 may hold 1-5 ml of liquid medicine, such as acetaminophen. Optionally, the valve 50 is configured to move from the closed position to the open position when the human sucks on the nipple exit aperture 46. Optionally, the nipple channel 48 is coated with silicone, the silicone coated channel 48 configured to allow liquid 12 to flow freely through the channel 48. Optionally, the valve 50 and the nipple entrance aperture 44 have the same shape. In other embodiments, as shown in FIGS. 4A and 5A, the valve 50 is generally cylindrical in shape and includes a sidewall 61 and the stem 58 includes an indentation 59 located adjacent to the stem rear side 62 and extending about a perimeter of the valve 50 (more particularly around the valve circumference if the valve 50 is generally cylindrical) that the valve 50 slides onto. In such embodiments, the nipple channel 48 may include protrusions 65 rearwardly disposed relative to the valve 50 to prevent the valve 50 from being sucked rearwardly and into the human's mouth as a safety feature. Optionally, the valve 50 and the nipple 36 are comprised of the same material. Optionally, the valve 50 comprises x-shaped slits 72, the x-shaped slits 72 configured to open when the human sucks on the nipple exit aperture 46. (More particularly, the x-shaped slits 72 contact each other when the valve 50 is in the closed position and move apart when the valve 50 is in the open position). The valve 50 may have thin walls and may be comprised of plastic or an elastomeric material for example.

Optionally, the medicine container 34 includes a drain 35 that feeds the liquid 12 to the medicine container exit aperture 56 and the drain 35 is flush with the internal wall 37 of the medicine container 34, as best seen in FIG. 4, in order to assist the flow of liquid 12 out of the medicine container 34.

The pacifier 10 may be used in a method that includes, for example, a) administering the pacifier 10 to a human so that the mouth guard rear side 18 is against the human's face; b) allowing the human to suck on the nipple exit aperture 46 and cause the valve 50 to move from the closed position to the open position; c) flowing (sequentially) a liquid 12 from the medicine container 34, through the nipple channel 48, through the nipple exit aperture 46 and into the human's mouth. As aforementioned, the liquid 12 may flow through other components such as valve 50. Optionally, step c) comprises flowing (sequentially) a medicinal liquid 12 from the medicine container 34, through the medicine container exit aperture 56, through the stem front side 60, through the hollow stem interior 64, through the stem rear side 62, through the nipple channel 48, through the nipple exit aperture 46 and into the human's mouth.

Optionally, the pacifier 10 is sterilized by the manufacturer and is for single use—i.e., disposable. In other words, no sterilization before or after use needs to be performed by the caregiver.

FIGS. 7-13 show a pacifier 100 of an alternate embodiment of the present invention. In some embodiments, the pacifier 100 includes a mouth guard 102 comprising a mouth guard rear side 106 configured to rest against the face of the human, a mouth guard front side 108 opposite the mouth guard rear side 106, and a mouth guard interior 110. In other words the mouth guard 102 forms a housing. The pacifier 100 further includes a medicine container 112 located entirely in the mouth guard interior 110 and configured to hold a medicinal liquid 104. The pacifier 100 further includes a nipple 114 comprising a nipple front side 116 extending from the mouth guard rear side 106, a nipple rear side 118 configured to be inserted in the human's mouth, a nipple interior 120, a nipple entrance aperture 122 located adjacent to the nipple front side 116, a nipple exit aperture 124 located adjacent to the nipple rear side 118, and a nipple channel 126 connecting the nipple entrance aperture 122 and the nipple exit aperture 124, the nipple channel 126 located in the nipple interior 120. The pacifier 100 further includes a spill proof valve 128 located between the medicine container 112 and the nipple exit aperture 124 (more specifically, located in the nipple channel 126 for example), the valve 128 having a closed position in which the valve 128 prevents liquid 104 located in the medicine container 112 from flowing out the nipple exit aperture 124 and an open position in which the valve 128 allows liquid 104 located in the medicine container 112 to flow out the nipple exit aperture 124. In other words, when the valve 128 is closed, the medicine container 112 is not in fluid communication with at least the nipple exit aperture 124.

The medicine container 112 is preferably rigid and non-compressible so that the shape of the medicine container 112 does not change when the human sucks on the nipple exit aperture 124.

Optionally, the mouth guard comprises a stem 129 comprising a stem front side 130 engaging the medicine container exit aperture 142, a stem rear side 132 engaging the nipple 114, and a hollow stem interior 134, and the medicine container 112 is in fluid communication with the stem front side 130, the stem rear side 132, the hollow stem interior 134, and the nipple exit aperture 124 when the valve 128 is in the open position. Optionally, when the valve 128 is in the open position, a medicinal liquid 104 located in the medicine container 112 is configured to flow (sequentially) from the medicine container 112, through the medicine container exit aperture 142, through the stem front side 130, through the hollow stem interior 134, through the stem rear side 132, through the nipple channel 126, through the nipple exit aperture 124 and into the human's mouth.

Optionally, the mouth guard 102 comprises a plurality of breathing holes 136 extending from the mouth guard front side 108 to the mouth guard rear side 106, the breathing holes 136 configured to allow the human to breathe through the breathing holes 136 when the nipple 114 is located in the human's mouth.

Optionally, the mouth guard front side 108 comprises a ring handle 138. Optionally, the medicine container 112 holds a single dose of liquid medicine 104. Optionally, the valve 128 is configured to move from the closed position to the open position when the human sucks on the nipple exit aperture 124. Optionally, the nipple channel 126 is coated with silicone, the silicone coated channel 126 configured to allow liquid 104 to flow freely through the channel 126. Optionally, the valve 128 and the nipple entrance aperture 122 have the same shape. Optionally, the valve 128 and the nipple 114 are comprised of the same material. Optionally, the valve 128 comprises x-shaped slits 140, the x-shaped slits 140 configured to open when the human sucks on the nipple exit aperture 124. (More particularly, the x-shaped slits 140 contact each other when the valve 128 is in the closed position and move apart when the valve 128 is in the open position). The valve 128 may be positioned on the stem 129 as described above with the prior embodiment and as illustrated in the prior embodiment in FIGS. 4A and 5A.

In some embodiments, the pacifier 100 is used in a method that includes: a) administering the pacifier 100 to a human so that the mouth guard rear side 106 is against the human's face; b) allowing the human to suck on the nipple exit aperture 124 and cause the valve 128 to move from the closed position to the open position; and c) flowing a liquid 104 (sequentially) from the medicine container 112, through the nipple channel 126, through the nipple exit aperture 124 and into the human's mouth.

Optionally, step c) comprises flowing a medicinal liquid 104 from the medicine container 112, through the medicine container exit aperture 142, through the stem front side 130, through the hollow stem interior 134, through the stem rear side 132, through the nipple channel 126, through the nipple exit aperture 124 and into the human's mouth.

Optionally, the pacifier 100 is sterilized by the manufacturer and is for single use—i.e., disposable.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention, as defined and limited solely by the following claims. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the side result is not significantly changed. For example, these terms can be construed as including a deviation of at least ±5% of the modified term if this deviation would not negate the meaning of the word it modifies.

The invention claimed is:

1. A pacifier configured to administer a liquid to a human having a face and a mouth, the pacifier comprising:

a mouth guard comprising a mouth guard rear side configured to rest against the face of the human, a mouth guard front side opposite the mouth guard rear side and comprising a flange extending away from the mouth guard front side generally perpendicular to the mouth guard front side;

a cap comprising a cap front side, a cap rear side, and a hollow cap interior between the cap front side and the cap rear side, the cap mating with the flange to form a pacifier housing comprising a pacifier housing interior;

a medicine container located in the pacifier housing interior and configured to hold a medicinal liquid, wherein the medicine container comprises a medicine container front side adjacent to the cap front side and a medicine container rear side adjacent to the mouth guard front side, wherein the medicine container rear side comprises a medicine container exit aperture, wherein the mouth guard comprises a stem comprising a stem front side engaging the medicine container exit aperture, a stem rear side engaging the nipple, and a hollow stem interior, and further wherein the medicine container is in fluid communication with the stem front side, the stem rear side, the hollow stem interior, and the nipple exit aperture when the valve is in the open position, wherein the stem comprises an indentation located adjacent to the stern rear side and extending about a perimeter of the stem, wherein the valve is generally cylindrical in shape and further wherein the valve is positioned in the indentation;

a nipple comprising a nipple front side extending from the mouth guard rear side, a nipple rear side configured to be inserted in the human's mouth, a nipple interior, a nipple entrance aperture located adjacent to the nipple front side, a nipple exit aperture located adjacent to the nipple rear side, and a nipple channel connecting the nipple entrance aperture and the nipple exit aperture, the nipple channel located in the nipple interior; and a valve located between the medicine container and the nipple exit aperture, the valve having a closed position in which the valve prevents liquid located in the medicine container from flowing out the nipple exit aperture and an open position in which the valve allows liquid located in the medicine container to flow out the nipple exit aperture.

2. The pacifier of claim 1 wherein the medicine container is located entirely within the pacifier housing interior.

3. The pacifier of claim 1, wherein when the valve is in the open position, a medicinal liquid located in the medicine container is configured to flow sequentially from the medicine container, through the medicine container exit aperture, through the stern front side, through the hollow stem interior, through the stem rear side, through the nipple channel, through the nipple exit aperture and into the human's mouth.

4. The pacifier of claim 1 wherein the cap rear side is flush with the mouth guard front side.

5. The pacifier of claim 1, wherein the flange forms a perimeter around a recessed area, the recessed area having a rear side defined by the mouth guard front side and further wherein the recessed area and the cap interior define the pacifier housing interior.

6. The pacifier of claim 1 wherein the medicine container is rigid.

7. The pacifier of claim 1 wherein the valve is configured to move from the closed position to the open position when the human sucks on the nipple exit aperture.

8. The pacifier of claim 1 wherein the nipple channel is coated with silicone, the silicone coated nipple channel configured to allow liquid to flow freely through the silicone coated nipple channel.

9. The pacifier of claim 1, wherein the valve and the nipple entrance aperture have the same shape and further wherein the valve and the nipple are comprised of the same material.

10. The pacifier of claim 1, wherein the valve comprises x-shaped slits, the x-shaped slits configured to open when the human sucks on the nipple exit aperture.

11. A method of administering medicine using a pacifier comprising a) administering the pacifier of claim 1 to a human so that the mouth guard rear side is against the human's face;

b) allowing the human to suck on the nipple exit aperture and cause the valve to move from the closed position to the open position; and c) flowing a liquid sequentially from the medicine container, through the nipple channel, through the nipple exit aperture and into the human's mouth.

12. The method of claim 11, wherein the medicine container of the pacifier comprises a medicine container front side adjacent to the cap front side and a medicine container rear side adjacent to the mouth guard front side, wherein the medicine container rear side comprises a medicine container exit aperture, wherein the mouth guard comprises a stem comprising a stem front side engaging the medicine container exit aperture, a stem rear side engaging the nipple, and a hollow stem interior, and step c) comprises flowing a medicinal liquid sequentially from the medicine container, through the medicine container exit aperture, through the stem front side, through the hollow stem interior, through the stem rear side, through the nipple channel, through the nipple exit aperture and into the human's mouth.

* * * * *